United States Patent [19]

Chisholm et al.

[11] 3,955,772

[45] May 11, 1976

[54] UNWINDING APPARATUS

[75] Inventors: James R. Chisholm, North Caldwell; Joseph E. Smith, New Providence, both of N.J.

[73] Assignee: GTE Sylvania Incorporated, Stamford, Conn.

[22] Filed: May 8, 1975

[21] Appl. No.: 575,599

[52] U.S. Cl. ..... 242/78.7; 242/66; 242/68.7

[51] Int. Cl.[2] ..... B21C 47/22

[58] Field of Search ..... 242/78.7, 68.7, 66, 242/78.6

[56] References Cited

UNITED STATES PATENTS

| | | | |
|---|---|---|---|
| 2,122,674 | 7/1938 | Wardle | 242/78.7 |
| 2,266,067 | 12/1941 | Nyberg | 242/78.7 |
| 2,267,161 | 12/1941 | Miller | 242/78.7 |
| 3,685,760 | 8/1972 | Fedor | 242/78.7 |
| 3,834,643 | 9/1974 | Sauveur | 242/78.7 |

*Primary Examiner*—Edward J. McCarthy
*Attorney, Agent, or Firm*—Norman J. O'Malley; Lawrence R. Fraley; Donald R. Castle

[57] ABSTRACT

There is described an apparatus for unwinding substantially round coils of strip material. The apparatus comprises a frame having two upstanding side members, a pair of alignment members adapted for movement toward and away from each other within the apparatus to align the coil, and a plurality of rollers for engaging the coil's periphery to achieve rotation of the coil.

7 Claims, 4 Drawing Figures

UNWINDING APPARATUS

BACKGROUND OF THE INVENTION

This invention relates to unwinding apparatus and more particularly to apparatus for unwinding substantially round coils of strip material. Even more particularly, this invention relates to such apparatus wherein the material to be unwound is relatively heavy, i.e., weighing in excess of 2,000 pounds.

Prior devices for unwinding heavy coils of the nature described have usually required manual participation by several operators to assure proper positioning and alignment of the coil during the unwinding sequence. This requirement in turn presented a hazardous condition to said operators, particularly when considering the weights and sizes of the materials being processed. Those devices which were more automated and therefore not as requiring of manual participation were most usually of substantial size as well as relatively complex to operate. Further, these devices were well known for requiring extensive maintenance to assure continuous successful operation.

It is believed therefore that an apparatus for unwinding relatively heavy coil material which is not large in size or substantially complex in operation would constitute an advancement in the art.

OBJECTS AND SUMMARY OF THE INVENTION

It is a primary objective of the present invention to provide an apparatus for unwinding relatively heavy coils of material.

It is another object of this invention to provide an apparatus of the nature described which would obviate the known disadvantages of prior art unwinding devices.

These objectives are accomplished in one aspect of the present invention by the provision of an unwinding apparatus comprising a frame having two opposing upstanding sides, a plurality of rollers for engaging the coil's periphery to provide rotation and positioning of the coil, and a pair of moveable alignment members for engaging the sides of the coil to maintain alignment thereof. A motion means is also included to impart the required motion to each of the alignment members. Additionally, a drive means is utilized to drive at least one of the rollers to provide the described rotation.

DESCRIPTION OF THE PREFERRED EMBODIMENTS

For a better understanding of the present invention, together with other and further objects, advantages and capabilities thereof, reference is made to the following disclosure and appended claims in connection with the above description of some of the aspects of the invention.

Figure 1:
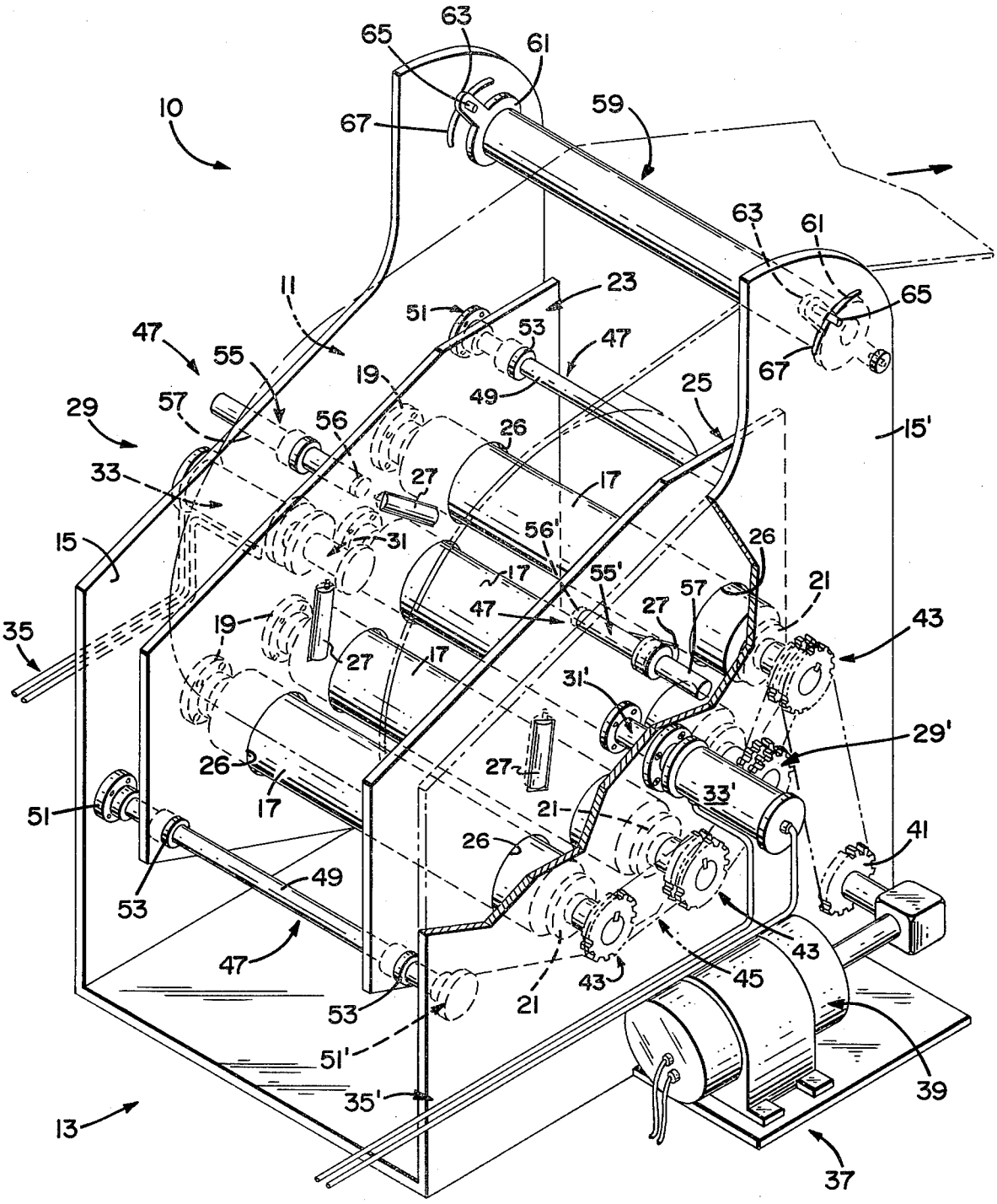
FIG. 1 is an isometric view of an unwinding apparatus in accordance with a preferred embodiment of the present invention.

With particular reference to FIG. 1, there is illustrated an apparatus 10 for unwinding a substantially round coil 11 (in phantom) of strip material as the coil is positioned within the apparatus. Apparatus 10 comprises a frame 13 which includes first and second opposingly positioned upstanding side members 15 and 15′ respectively. Positioned within apparatus 10 and substantially between side members 15 and 15′ are a plurality of spacedly positioned rollers 17 for rotatably engaging the periphery of coil 11 over a substantial arc. By doing so, rollers 17 are adapted for rotating and positioning coil 11 within apparatus 10. In the preferred embodiment of the invention, the number of rollers utilized is four. However, this is not means to be limitive with regard to the broad concept of the present invention. That is, varying numbers of rollers could be successfully utilized to achieve substantially the same results.

Each roller 17 has a first end portion 19 securedly positioned to first upstanding side 15. Additionally, each roller has a second end portion 21 securedly positioned to second upstanding side member 15′. Each of rollers 17 preferably comprises an outer layer of a relatively hard rubber composition to provide positive frictional engagement with the periphery of coil 11.

For reasons of clarity, a portion of second side 15′ has been cut away to more accurately illustrate the positioning of several of the components of apparatus 10. It is to be understood however that second side 15′ is substantially similar in configuration to first upstanding side 15.

Apparatus 10 further comprises first and second opposingly positioned alignment members 23 and 25 respectively. Each of these members is movably oriented within apparatus 10 substantially between first and second upstanding sides 15 and 15′ for moving toward and away from each other to engage the sides of coil 11 and therefore maintain alignment thereof. Members 23 and 25 are each adapted for passing over rollers 17 as a result of each of members 23 and 25 being provided with a series of openings 26 larger in size than the outer diameters of rollers 17. As can be seen, members 23 and 25 thereby assure continual alignment of coil 11 during the unwinding sequence, thus prohibiting the coil from tipping over. To facilitate the unwinding of coil 11, each of the described alignment members 23 and 25 is provided with at least one secondary roller 27 which is positioned within the alignment member for rotatably engaging a side of the coil. The preferred number of secondary rollers utilized in apparatus 10 is four, with each of the alignment members having two positioned therein. As stated, the main function of secondary rollers 27 is to facilitate the unwinding of coil 11 by reducing the surface friction between the illustrated engaging members and the sides of the coil. However, it is to be understood that in the broader aspects of the present invention, these members could be deleted from the apparatus with successful unwinding still achieved.

To provide the necessary movement of alignment members 23 and 25, apparatus 10 further comprises motion means 29 and 29′. Each of said motion means is operatively connected to one of the described alignment members for imparting motion thereto to provide the described movement of the alignment members toward and away from each other as they pass over rollers 17. In the preferred embodiment of the invention, each motion means comprises a hydraulically actuated piston (31 and 31′ respectively). As illustrated, each piston is operatively connected to one of the alignment members and is operated hydraulically via a corresponding master cylinder (33 and 33' respectively). Fluid is supplied to the described master cylinders through a series of tubular supply lines 35 and 35'. Lines 35 and 35' are in turn joined to a suitable hydraulic supply source (not shown) and a corresponding valving control means (also not shown). The latter mentioned components are well known in the art and do not constitute the inventive concept of the present invention. Accordingly, further description of such components is not considered necessary.

As illustrated in FIG. 1, apparatus 10 further comprises a drive means 37 which is operatively joined to at least one of the described rollers 17 for driving this roller to provide the described rotation of coil 11 within apparatus 10. Drive means 37 is illustrated as an electrically powered motor 39 and a corresponding gear member 41. Accordingly, motor 39 drives gear 41 at the speed range necessary to achieve the desired rate of unwinding of coil 11 in the manner illustrated. As can be appreciated motor 39 is electrically joined to an external power source (not shown) and is engaged through a switching or similar electrical mechanism (also not shown) when operation of the drive means 37 is required. Similar to the mentioned components for the hydraulically actuated piston members 31 and 31', the latter mentioned components (external power source and switching mechanism) are well known in the art and further description is therefore not considered necessary.

As illustrated in FIG. 1, each of the shown roller members is adapted for being driven either directly or indirectly by drive means 37. This is achieved by providing each of the end shafts of rollers 17 with a gear 43 or similar member. Accordingly, each gear 43 is interconnected through a series of chains 45 or similar drive interconnecting means. As illustrated in FIG. 1, the gear end for the roller which is operatively connected to the drive means 37 is in turn operatively joined to the gear for the roller immediately adjacent thereto. Similarly, this roller is operatively joined through the described gear and chain arrangement to the next adjacent roller and so forth. This positioning as illustrated is preferred to reduce the interconnecting chain lengths in addition to providing less opportunity for slippage and mechanical failure. It can be seen that although a gear and chain assembly is utilized, other types of interconnecting and drive members could be incorporated herein. For example, a series of pulleys and drive belts could be incorporated to achieve substantially the same function. It is preferred, however, to use the illustrated chain and gear assemblies to reduce the possibility of slippage particularly when considering the weights of the materials which can be unwound by apparatus 10.

As can be understood, apparatus 10 is particularly adaptable for unwinding substantially heavy coils of materials. A particular example of a material which can be successfully unwound by apparatus 10 is a 48 inch diameter coil of steel or similar metal having a width of approximately 16 inches and a thickness of about 0.250 inches. Such a coil of material usually weighs in excess of 2,000 pounds and it can therefore be appreciated that unwinding a coil of such size and weight can be both a complex and a relatively hazardous operation.

Concerning material of this nature, it is not uncommon for the width of such material to vary extensively. Thus, unwinding of such material is even further complicated. Due to this varying width possibility, it is preferred in the present invention to utilize the described hydraulically actuated motion means 29 and 29'. Use of hydraulics in this particular application additionally provides a shock absorbing function as would be caused by the coil varying in its width dimension during the unwinding process. That is, each of the pistons 31 and 31' would be capable of providing sufficient resilence during such variances while still maintaining proper alignment of coil 11. This resilence provides one of several distinct features of the present invention.

To facilitate alignment of members 23 and 25 during the described movement of these members, apparatus 10 can further include guide means 47. Guide means 47 serve to guide each of the alignment members 23 and 25 during this movement and therefore assure alignment thereof. As illustrated in FIG. 1, guide means 47 comprises a plurality of spacedly positioned shaft members 49 (two are shown), each having first and second opposing end portions 51 and 51'. First end portion 51 of each shaft 49 is fixedly positioned within upstanding side 15 while second end portion 51' is fixedly positioned within second upstanding side 15'. Accordingly, each of the alignment members 23 and 25 are adapted for being slidably moved over shafts 49 during the described movement toward and away from each other. This is achieved by providing members 23 and 25 with a corresponding pair of sliding bushings 53. A third shaft member 49 similar to those illustrated is also provided and shown in FIGS. 2–4.

Guide means 47 additionally comprises first and second rod members 55 and 55'. First rod member 55 has a first end 56 securedly affixed to first alignment member 23 and a second opposing end 57 slidably positioned within side member 15. Accordingly, when the alignment member 23 moves toward and away from the opposing alignment member, the second opposing end 57 of rod 55 is slidably moved within first upstanding side 15. Similarly, second rod member 55' has a first end 56' securedly affixed to second alignment member 25 and a second opposing end portion 57' for moving in the same manner as opposing end 57 of first rod 55.

The preferred positioning of rollers 17 and shafts 49 is achieved utilizing suitable bearings or similar components for housing the respective ends of such members. Such components are well known in the art and description is therefore not considered necessary.

Apparatus 10 further includes an adjustable roller 59 which is adapted for engaging the portion of the strip material unwinding from coil 11. It is preferred to provide roller 59 in an adjustable relationship to therefore provide a means whereby the tension on this portion of the material being unwound can be adjusted. This is achieved in the manner illustrated by providing roller 59 with a pair of corresponding end caps 61 each having a protruding portion 63 which includes therein a locating pin 65. This pin in turn is adapted for being movably oriented within a provided slot 67. The described roller 59 and corresponding components are added merely to provide the desired tensioning function. Accordingly, such a component does not constitute the inventive concept of the present invention and is added primarily to provide apparatus 10 with another desirable operating feature.

Figure 2:
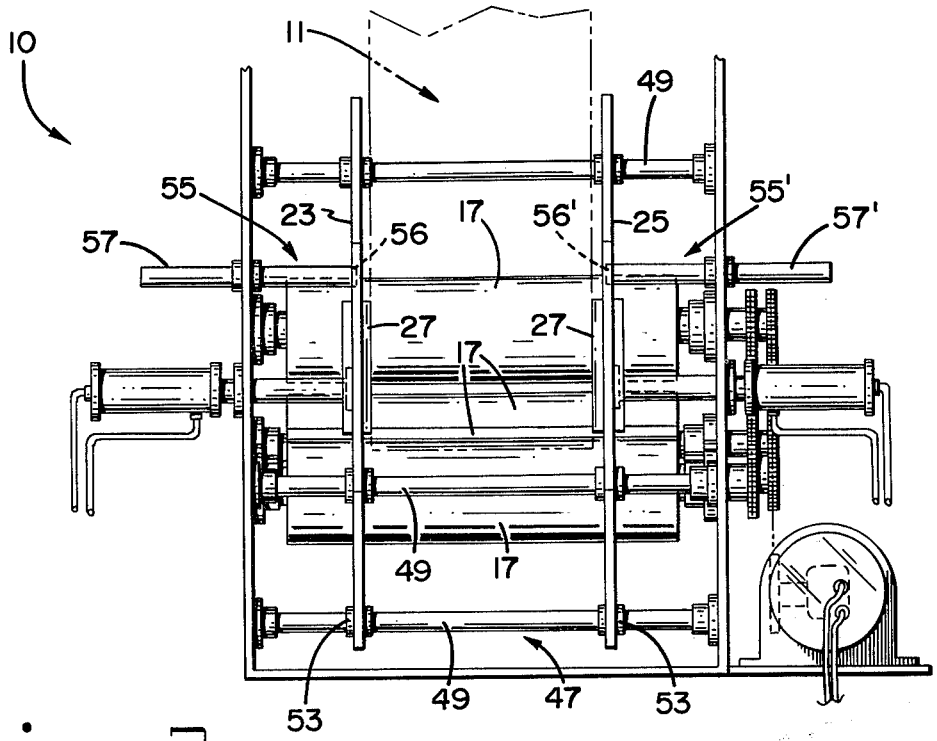
FIGS. 2 and 3 are end elevational views of the apparatus of FIG. 1.
Figure 3:
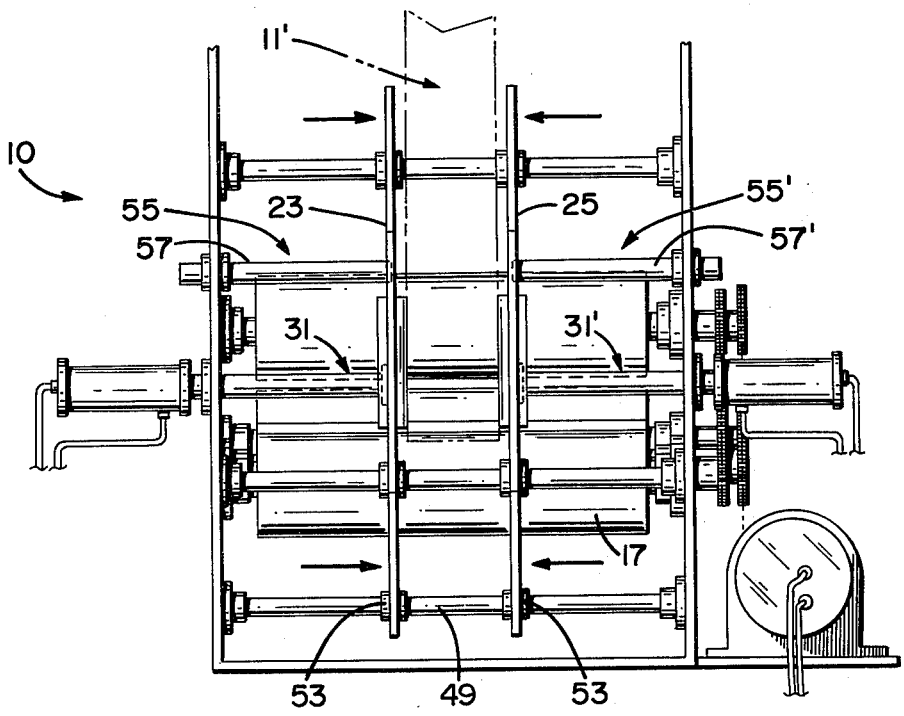

FIGS. 2 and 3 are end views of apparatus 10 illustrating the various positioning relationship of the moveable components of the apparatus. In FIG. 2, a substantially wide coil 11 (in phantom) is capable of being unwound. As can be seen, each of the alignment members 23 and 25 have been moved to provide the necessary engagement of the sides of coil 11, thus securing its alignment within the apparatus. As can further be seen in FIG. 2, secondary rollers 27 are in rotatable engagement with the coil. Also illustrated are the positioning relationships of rollers 17 as they engage a substantial arc of the periphery of coil 11.

In FIG. 2, there is also illustrated the lower or third shaft 49 of the aforementioned guide means 47. The remaining two shaft members 49 are also clearly illustrated.

In FIG. 3, the aforementioned moveable components of apparatus 10 are illustrated as they have moved to engage and unwind a coil 11' (in phantom) of substantially less width than that of coil 11 in FIGS. 1 and 2. More specifically, alignment members 23 and 25 have been moved toward each other as a result of the motion provided by hydraulically actuated pistons 31 and 31'. Further, a clear illustration of the movement of rods 55 and 55' is provided. This is, each of the respective end portions 57 and 57' have been slidably moved within upstanding side members 15 and 15' respectively. As will be understood with the description of FIG. 4, rod members 55 and 55' are utilized in the manner illustrated to provide a means whereby coils of significantly large diameters may be unwound within apparatus 10. Use of rods 55 and 55' at this location in apparatus 10, in addition to the illustrated use of shaft members 49 at their respective locations assures a four point sliding engagement for each of the alignment members 23 and 25 within apparatus 10. A clearer illustration of the positioning relationships of shafts 49 and rods 55 (shown hidden) is provided in FIG. 4. This positioning relationship thus provides positive alignment of members 23 and 25 within apparatus 10 during their described movement to engage the positioned coil.

Figure 4:
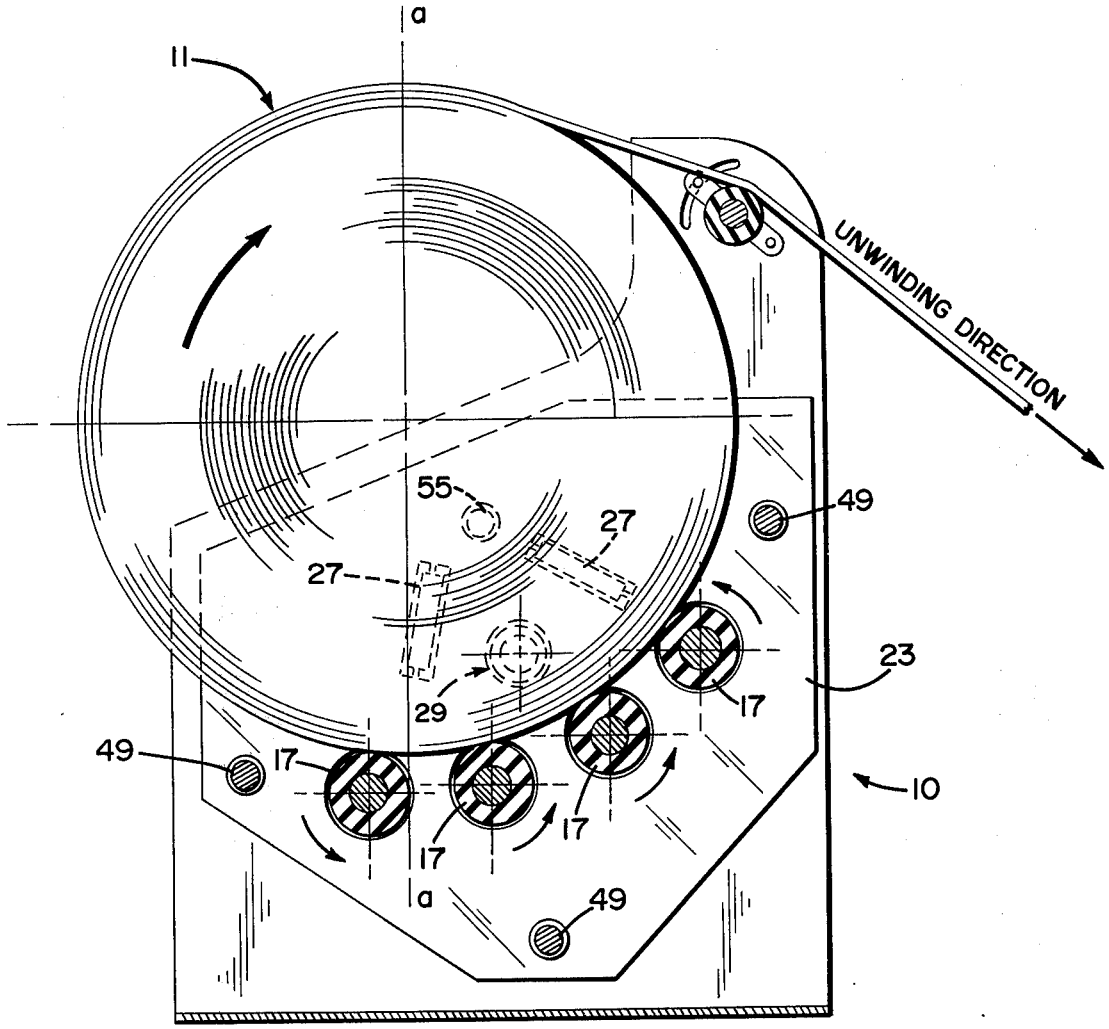
FIG. 4 is a side elevational view, partly in section, of the apparatus of FIG. 1.

With particular reference to FIG. 4, a side elevational view, partly in section, is provided to more clearly illustrate the positions of the spacedly positioned rollers 17 with regard to the respective position of coil 11, which is being unwound by apparatus 10. As can be seen, it is preferred to position the lowermost roller somewhat offset to the left from the vertical axis a-a which passes through the center of coil 11. That is, the lowermost roller is offset from axis *a—a* in an opposing manner from the direction of unwinding as illustrated in FIG. 4. This positioning relationship assures a steady positioning of the coil within apparatus 10 during the described unwinding. As can be seen, this prevents coil 11 from tipping or rotating off apparatus 10 in the direction opposite the unwinding direction. As is also seen in FIG. 4, it is preferred to position the remaining three rollers on the side of axis *a—a* toward the direction of unwinding. This positioning relationship in turn prevents the coil from unwinding itself in such a manner so as to pass over these rollers, thus removing itself from apparatus 10 during the illustrated unwinding. As can further be seen in FIG. 4, the positioning relationships of the four roller members 17 provides for engagement of coil 11 over a substantial arc thereof, this arc being primarily offset from the central vertical axis a-a of coil 11 in the direction of unwinding. Accordingly, rollers 17 are positioned to more positively react to the angular downward force exerted by coil 11, this force occurring substantially down and to the right of axis *a—a*. This in turn provides for a more secure positioning of the coil within apparatus 10 in addition to facilitating its unwinding as caused by the rotatable engagement of the periphery by each of the described rollers.

Also illustrated in FIG. 4 is the positioning relationship of secondary rollers 27 (shown hidden) as oriented within first alignment member 23. The positioning of motion means 29 (shown hidden) as it engages first alignment member 23 is also provided. The remaining components of apparatus 10, including second alignment member 25 and second upstanding side 15', have been removed for purposes of clarification.

Thus there has been shown and described an unwinding apparatus which is capable of unwinding a substantially round coil of strip material positioned therein. The apparatus is considered unique in that it provides a substantially automated means for unwinding relatively heavy coiled material in a facile manner.

While there has been shown and described what are at present considered the preferred embodiments of the invention, it will be obvious to those skilled in the art that various changes and modifications may be made therein without departing from the scope of the invention as defined by the appended claims.

What is claimed is:

1. An apparatus for unwinding a substantially round coil of strip material, said apparatus comprising:

a frame including first and second opposingly positioned upstanding side members;

a plurality of spacedly positioned rollers for engaging the periphery of said coil over a substantial arc to rotate and position said coil within said apparatus, each of said rollers having a first end portion securedly positioned to said first upstanding side member of said frame and a second end portion securedly positioned to said second upstanding side member of said frame;

first and second opposingly positioned alignment members movably oriented within said apparatus substantially between said first and second upstanding side members for moving toward and away from each other to engage the sides of said coil and maintain alignment thereof;

motion means including a pair of hydraulically actuated piston members, each of said piston members operatively connected to one of said alignment members for imparting motion thereto to provide said movement of said alignment members toward and away from each other; and drive means operatively joined to at least one of said spacedly positioned rollers for driving said roller to provide said rotation of said coil within said apparatus.

2. The unwinding apparatus according to claim 1 wherein said first and second alignment members are adapted for moving over each of said spacedly positioned rollers during said movement toward and away from each other.

3. The unwinding apparatus according to claim 1 wherein the number of said spacedly positioned rollers is four.

4. The unwinding apparatus according to claim 1 further including at least one secondary roller positioned within each of said alignment members for rotatably engaging the sides of said coil.

5. The unwinding apparatus according to claim 1 further including guide means for guiding said first and second alignment members during said movement toward and away from each other.

6. The unwinding apparatus according to claim 5 wherein said guide means comprises a plurality of spacedly positioned shaft members, each of said shaft members having first and second opposing end portions, said first end portion fixedly positioned within said first upstanding side member, said second end portion fixedly positioned within said second upstanding side member.

7. The unwinding apparatus according to claim 6 wherein said guide means further comprises first and second rod members, said first rod member having a first end securedly affixed to said first alignment member and a second opposing end slidably positioned within said first upstanding side member, said second rod member having a first end securedly affixed to said second alignment member and a second opposing end slidably positioned within said second upstanding side member.

* * * * *

UNITED STATES PATENT OFFICE

CERTIFICATE OF CORRECTION

PATENT NO. : 3,955,772

DATED : May 11, 1976

INVENTOR(S) : JAMES R. CHISHOLM and JOSEPH E. SMITH

It is certified that error appears in the above-identified patent and that said Letters Patent are hereby corrected as shown below:

Please change the Assignee from:

GTE SYLVANIA INCORPORATED, Stamford, Conn.

to: WILBUR B. DRIVER COMPANY, Newark, N.J.

Col. 2, line 11 After "hot", delete means and insert --meant--.

Col. 5, line 19 After "provided.", delete This and insert --That--.

Signed and Sealed this

Twentieth Day of July 1976

[SEAL]

*Attest:*

RUTH C. MASON
*Attesting Officer*

C. MARSHALL DANN
*Commissioner of Patents and Trademarks*